US011156054B2

(12) United States Patent
Alsup et al.

(10) Patent No.: US 11,156,054 B2
(45) Date of Patent: Oct. 26, 2021

(54) ANNULAR BLOWOUT PREVENTER

(71) Applicant: ELECTRICAL SUBSEA & DRILLING AS, Straume (NO)

(72) Inventors: John L. Alsup, Houston, TX (US); Bolie C. Williams, Houston, TX (US); J. Gilbert Nance, Katy, TX (US); Erik Norbom, Hoevik (NO); Thor Arne Haverstad, Vennesla (NO)

(73) Assignee: ELECTRICAL SUBSEA & DRILLING AS, Straume (NO)

( * ) Notice: Subject to any disclaimer, the term of this patent is extended or adjusted under 35 U.S.C. 154(b) by 320 days.

(21) Appl. No.: 16/088,820

(22) PCT Filed: Mar. 28, 2017

(86) PCT No.: PCT/NO2017/050074

§ 371 (c)(1),
(2) Date: Sep. 27, 2018

(87) PCT Pub. No.: WO2017/171555

PCT Pub. Date: Oct. 5, 2017

(65) Prior Publication Data

US 2019/0112889 A1 Apr. 18, 2019

(30) Foreign Application Priority Data

Mar. 30, 2016 (NO) ..... 20160506
Mar. 30, 2016 (NO) ..... 20160507
Mar. 30, 2016 (NO) ..... 20160508

(51) Int. Cl.
*E21B 33/06* (2006.01)

(52) U.S. Cl.
CPC ..... *E21B 33/06* (2013.01)

(58) Field of Classification Search
CPC ..... E21B 33/06; E21B 33/061; E21B 33/062; E21B 33/085; E21B 33/063
USPC ..... 251/1.1, 1.2, 1.3
See application file for complete search history.

(56) References Cited

U.S. PATENT DOCUMENTS 3,572,627 A 3/1971 Jones
3,572,628 A * 3/1971 Jones ..... E21B 33/06 251/1.2
3,897,038 A 7/1975 Le Rouax
3,897,039 A * 7/1975 Le Rouax ..... E21B 33/06 251/1.2
3,915,424 A 10/1975 LeRouax
(Continued)

*Primary Examiner* — Kevin F Murphy
*Assistant Examiner* — Jonathan J Waddy
(74) *Attorney, Agent, or Firm* — Norman B. Thot

(57) ABSTRACT

A packer actuation system for a blowout preventer includes a packer arrangement with an axial passage therethrough, an actuation system which is releasably mechanically connected to the packer arrangement, a contractor arrangement, and a retractor arrangement. The actuation system moves the packer arrangement from an expanded position to a contracted position so as to decrease a dimension of the axial passage, and to move the packer arrangement from the contracted position to the expanded position so as to increase the dimension of the axial passage. The contractor arrangement moves the packer arrangement from the expanded position to the contracted position. The retractor arrangement moves the packer arrangement from the contracted position to the expanded position.

7 Claims, 10 Drawing Sheets

(56) References Cited

U.S. PATENT DOCUMENTS

| | | | | |
|---|---|---|---|---|
| 3,915,425 | A | 10/1975 | LeRouax | |
| 3,915,426 | A | 10/1975 | LeRouax | |
| 3,994,472 | A | 11/1976 | Williams | |
| 4,007,904 | A | 2/1977 | Jones | |
| 4,095,805 | A | 6/1978 | Allen | |
| 4,099,699 | A | 7/1978 | Allen | |
| 4,229,012 | A * | 10/1980 | Williams, III | E21B 33/06 251/1.3 |
| 4,444,404 | A | 4/1984 | Parks, Jr. | |
| 4,458,876 | A | 7/1984 | Schaeper et al. | |
| 4,460,151 | A | 7/1984 | Williams, III et al. | |
| 4,579,314 | A | 4/1986 | Schaeper et al. | |
| 5,289,883 | A * | 3/1994 | Robinson | E21B 33/062 166/100 |
| 6,367,804 | B1 * | 4/2002 | Watts | E21B 33/062 251/1.2 |
| 2004/0124380 | A1 * | 7/2004 | Van Winkle | E21B 33/06 251/1.3 |
| 2005/0006087 | A1 * | 1/2005 | Melancon | E21B 33/062 166/106 |
| 2010/0152901 | A1 | 6/2010 | Judge et al. | |
| 2012/0073815 | A1 * | 3/2012 | Springett | E21B 33/062 166/297 |
| 2012/0227987 | A1 | 9/2012 | Castriotta et al. | |
| 2016/0090809 | A1 * | 3/2016 | Al-Badran | E21B 33/061 166/244.1 |
| 2018/0058169 | A1 * | 3/2018 | Le | E21B 33/085 |

* cited by examiner

ANNULAR BLOWOUT PREVENTER

CROSS REFERENCE TO PRIOR APPLICATIONS

This application is a U.S. National Phase application under 35 U.S.C. § 371 of International Application No. PCT/NO2017/050074, filed on Mar. 28, 2017 and which claims benefit to Norwegian Patent Application No. 20160506, filed on Mar. 30, 2016, to Norwegian Patent Application No. 20160507, filed on Mar. 30, 2016, and to Norwegian Patent Application No. 20160508, filed on Mar. 30, 2016. The International Application was published in English on Oct. 5, 2017 as WO 2017/171555 A1 under PCT Article 21(2).

FIELD

The present invention relates to a packer actuation system for a blowout preventer (BOP). A blowout preventer is typically used to drill a wellbore, which may be into a subterranean fluid reservoir and/or be used in the production of a fluid, such as hydrocarbon fluids, from such a reservoir.

BACKGROUND

The drilling of a borehole or well is typically carried out using a steel pipe known as a drill pipe or drill string with a drill bit on the lowermost end. The drill string comprises a series of tubular sections which are connected end to end. The entire drill string is typically rotated using a rotary table mounted on top of the drill pipe, and as drilling progresses, a flow of mud is used to carry the debris created by the drilling process out of the wellbore. Mud is pumped down the drill string to pass through the drill bit, and returns to the surface via the annular space between the outer diameter of the drill string and the wellbore (generally referred to as the annulus). For a subsea well bore, a tubular, known as a riser, extends from the rig to the top of the wellbore and provides a continuous pathway for the drill string and the fluids emanating from the well bore. The riser in effect extends the wellbore from the sea bed to the rig, and the annulus also comprises the annular space between the outer diameter of the drill string and the riser.

The use of blow out preventers to seal, control and monitor oil and gas wells is well known, and blow out preventers are used on both land and off-shore rigs. Blowout preventers are generally arranged in combinations that include ram-type and annular BOPs, connectors, valves, and control systems that enable actuation of the various pressure control functions. These combinations are called BOP stacks. During drilling of a typical high-pressure wellbore, the drill string is routed through a BOP stack toward a reservoir of oil and/or gas. The BOP is operable to seal around the drill string, thus closing the annulus and stopping a flow of fluid from the wellbore. The BOP stack may also be operable to sever the drill string to close the wellbore completely. Two types of BOP are in common use, ram and annular, and a BOP stack typically includes at least one of each type.

Blowout preventers (BOPs) were developed to cope with extreme erratic pressures and uncontrolled flow emanating from a well reservoir during drilling. Known as a "kick", this flow of pressure can lead to a potentially catastrophic event called a "blowout". In addition to controlling the downhole well pressure and the flow of oil and gas, blowout preventers are intended to prevent tubular goods used in well drilling, such as, drill pipe, casing, collars, tools and drilling fluid, from being blown out of the wellbore when a kick or blowout threatens. Blowout preventers are critical to the safety of crew, the drilling rig, the environment, and to the monitoring and maintenance of well integrity; blowout preventers are thus intended to provide an additional and fail-safe barrier to the systems in which they are included.

Annular blowout preventers can be used as a part of a subsea BOP stack in order to enable an immediate response to a kick. Annular preventers can close on a wide variety of drill string elements such as tool joints, collars, casing etc. so that it is not necessary to determine which element of the drill string is located inside the annular BOP before closing it. Ram type BOPs can only close on a restricted range of drill string elements, it is therefore necessary to take the time to determine what part of the drill string is located inside the ram BOP before closing it. Annular BOPs may also enable BOP coverage for drill string elements which would not be practical to cover with a combination of ram type BOPs. Annular BOPs may also enable moving the drill string while sealing the annulus between the drill string and the well bore, which is desirable in certain well control operations.

Related solutions in the field of annular blow out preventers which may be useful for understanding and practicing the present invention include U.S. Pat. Nos. 3,572,627, 3,897,038, 4,099,699, 4,458,876, 4,579,314, 3,994,472, 3,915,424, 3,915,426, 4,458,876, 4,460,151, 4,007,904 and 3,915,425.

BOPs are safety-critical components and there is a continuous need for solutions which improve the reliability and operational performance of such systems. It is moreover very time-consuming and expensive to pull the BOP to the surface for maintenance when BOPs are used subsea.

SUMMARY

An object of the present invention is to provide an annular blow out preventer having a structure that provides improved performance compared to previously-described solutions.

In an embodiment, the present invention provides a packer actuation system for a blowout preventer which includes a packer arrangement comprising an axial passage therethrough, an actuation system which is releasably mechanically connected to the packer arrangement, a contractor arrangement, and a retractor arrangement. The actuation system is operable to move the packer arrangement from an expanded position to a contracted position so as to decrease a dimension of the axial passage, and to move the packer arrangement from the contracted position to the expanded position so as to increase the dimension of the axial passage. The contractor arrangement is operable to move the packer arrangement from the expanded position to the contracted position. The retractor arrangement is operable to move the packer arrangement from the contracted position to the expanded position.

BRIEF DESCRIPTION OF THE DRAWINGS

The present invention is described in greater detail below on the basis of embodiments and of the drawings in which.

DETAILED DESCRIPTION

Figure 1:
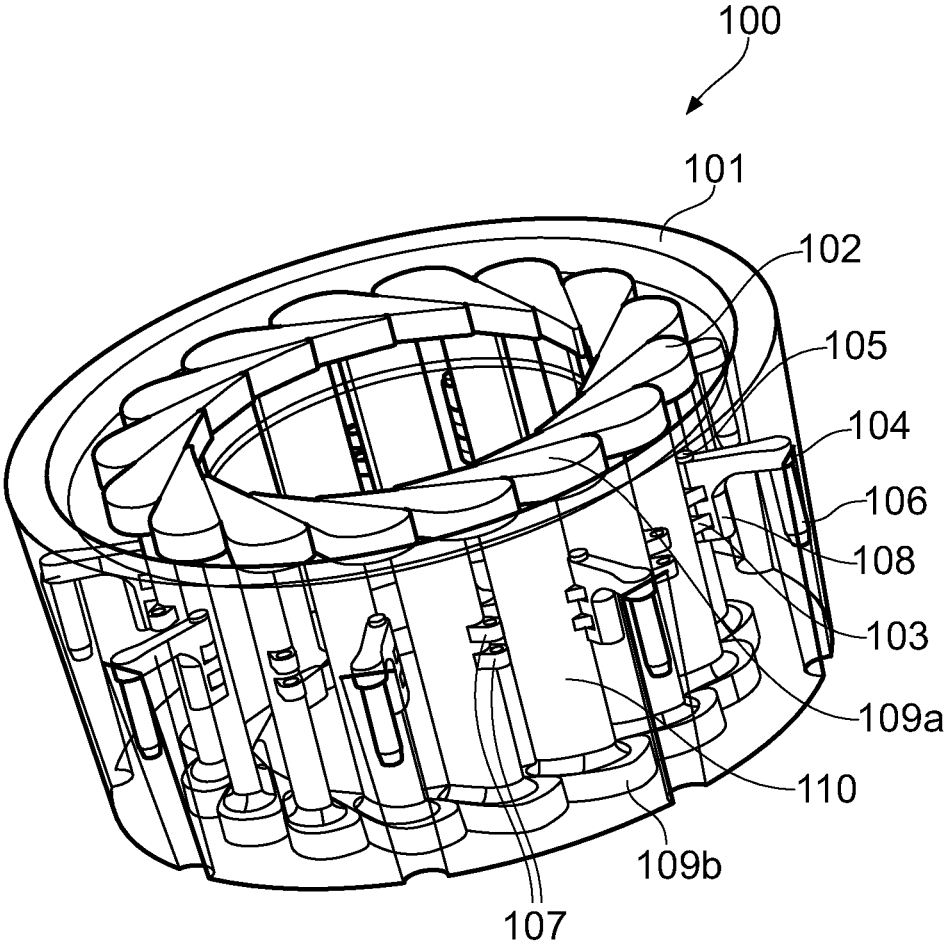
FIG. 1 shows a packing element for an annular blow out preventer.

In an embodiment, the present invention provides a packer actuation system for a blowout preventer, comprising:

a packer arrangement having an axial passage therethrough; and an actuation system which is releasably mechanically connected to the packer arrangement;

wherein the actuation system is operable to move the packer arrangement from an expanded position to a contracted position so that a dimension of the axial passage decreases, and the actuation system is operable to move the packer arrangement from the contracted position to the expanded position so that the dimension of the axial passage increases.

In an embodiment, the present invention provides a blowout preventer of the type having a resilient packer element comprising a contractor arrangement which has a plurality of plates adjacent one another which enclose an area, the contractor arrangement being configured to move from an expanded position to a contracted position in which the enclosed area decreases, wherein adjacent plates are configured to interlock with one another when in the contracted position.

In an embodiment, the present invention provides a packer actuation system for a blowout preventer comprising: a packer arrangement having an axial passage therethrough; an actuation system comprising a movable actuation element, the actuation system being operable to move the packer arrangement via the movable actuation element from an expanded position to contracted position so that the dimension of the axial passage decreases; and a position sensor arranged to measure the position of the movable actuation element.

In an embodiment, the present invention provides a method for determining the condition of a packer arrangement for an annular blow out preventer, the method comprising the steps: (a) providing a packer actuation system; (b) actuating the packer actuation system; (c) reading a position value of a movable actuation element measured by the position sensor; and (d) comparing the position value to a pre-determined, nominal position value.

Further features of embodiments of the present invention are set out in the appended claims.

The basic functionality of an annular blow out preventer (BOP) is well known in the art and will not be detailed in greater detail herein. Reference is made to the above mentioned patent documents.

An annular BOP according to one embodiment of the present invention may have a sealing element contained within an external housing, referred to as the packer or packing element, and a double-acting hydraulic actuator mounted within or connected to the housing. The actuator, for example in the form of a piston/cylinder arrangement, forces the annular sealing element inwards via a plurality of pusher plates, until it engages with the external surface of the drill pipe positioned in the BOP's internal passageway (also known as a bore). Releasing the pressure on the actuator, or actively driving it in the radially outwardly direction, releases the force from the pusher plates on the sealing element, thus allowing the element to relax to its original position away from the drill pipe body.

In the herein described embodiments, the actuators are hydraulic piston/cylinder arrangements, however, the actuators may be of any type, for example, electro-mechanical or pneumatic actuators.

FIG. 1 shows a packer arrangement 100 for an annular blowout preventer according to one embodiment of the present invention. The packer arrangement 100 comprises an annular packer element 101 made of resilient material, e.g., an elastomer, which has a substantially central axial passageway (shown transparent in the drawings for clarity). The packer arrangement 100 is provided with packer (also known as anti-extrusion) inserts, e.g., 102, disposed within the annular packer element 101. Each anti-extrusion insert comprises an upper body 109*a*, a lower body 109*b*, and a stem 110 which is substantially parallel to the axial passageway 211 through the packer arrangement 100 (the stem 110 may also be parallel to the longitudinal axis of the housing). The stem 110 joins the upper body 109*a* to the lower body 109*b*. The plurality of packer inserts 102 are provided in the packing element in a circumferential arrangement in relation to the packer element's central axial passageway or bore 211.

In the embodiment shown in FIG. 1, the upper and lower bodies 109*a*, 109*b* are substantially triangular-shaped and have a generally vertical stem 110 arranged in between. The stems 110 are provided with connection formations 103 for a retractor part 104. Each connection formation 103 has one or more recesses or openings 107 to permit the insertion of a connection pin 105 between the retractor part 104 and the connection formation 103. The retractor part 104 has a body 108 complementary to the connection formations 103 for receipt of the connection pin 105. The retractor part 104 can thus be connected to the packer inserts 102.

Figure 2:
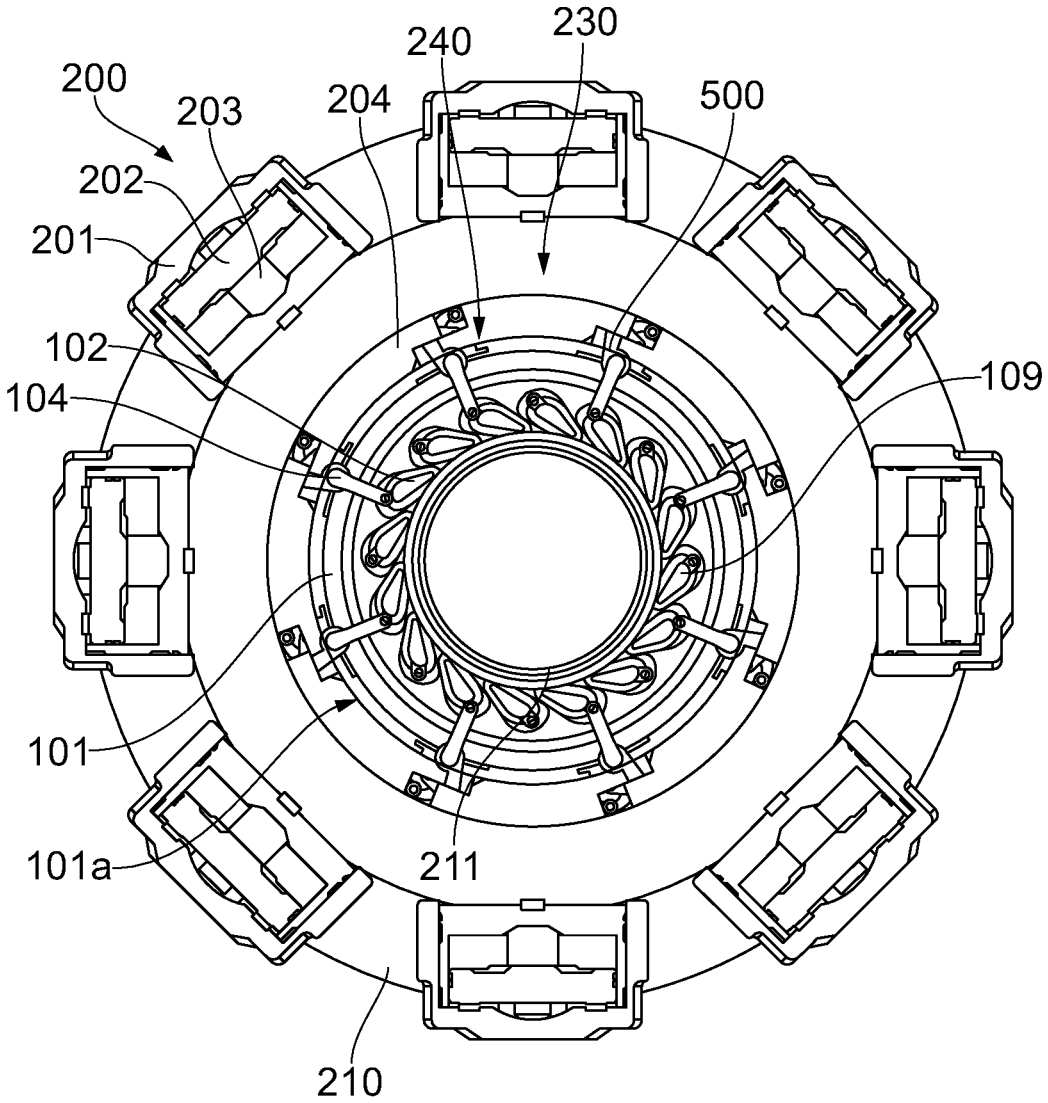
FIG. 2 shows an annular blow out preventer seen from above, comprising a packing element as shown in FIG. 1.

FIG. 2 shows a packer actuation system in a plan view, including the packer arrangement 100 shown in FIG. 1. The packer actuation system comprises the packer arrangement 100 and an actuation system. The actuation system comprises at least one double-acting actuator 200, a contractor arrangement 230, and a retractor arrangement 240. In the embodiment shown in FIG. 2, there is a plurality of double-acting actuators 200 with hydraulic actuation cylinders 201 located within the housing 210 of the annular blowout preventer. Each hydraulic actuation cylinder 201 has a piston 202 with a piston stem 203, the piston 202 dividing the hydraulic actuation cylinder 201 into an open chamber 201*a* and a closed chamber 201*b*.

The contractor arrangement 230 includes a plurality of arcuate/curved plates (also called pusher plates) 204 positioned adjacent one another. Each piston stem 203 is connected to a respective pusher plate 204 (see also FIG. 3). The pusher plates 204 enclose an area (and in some embodiments may form a discontinuous circular element) that surrounds an outer periphery 101*a* of the annular packer element 101.

Each pusher plate 204 is arranged to apply a radial pressure force on the outer circumference of the annular packer element 101, so as to move the annular blowout preventer from an expanded position towards a contracted position when a force is applied by actuators 200, so that the area of the axial passageway through the packer arrangement 100 decreases.

A packer retractor mechanism 500 (also called a packer retraction linkage 500) is provided at each intersection between two pusher plates 204. The retractor part 104 is connected to the packer retractor mechanism 500. FIG. 2 shows that each retractor part 104 is attached to a packer retractor mechanism 500 at one end and to one of the packer inserts 102 at the other end. The connection of the retractor part 104 to a packer retractor mechanism 500 will be discussed in greater detail below in relation to FIGS. 5 and 6.

In the embodiment shown in FIG. 2, the triangular shaped upper and lower bodies 109*a*, 109*b* of each packer insert 102 are in contact with the adjacent triangular shaped upper and lower body 109*a*, 109*b* of the adjacent packer insert 102 so that the triangular shaped upper and lower bodies 109*a*, 109*b* form a ring shaped element surrounding the central passageway or bore 211, around which the annular packer element 101 is positioned.

Figure 3:
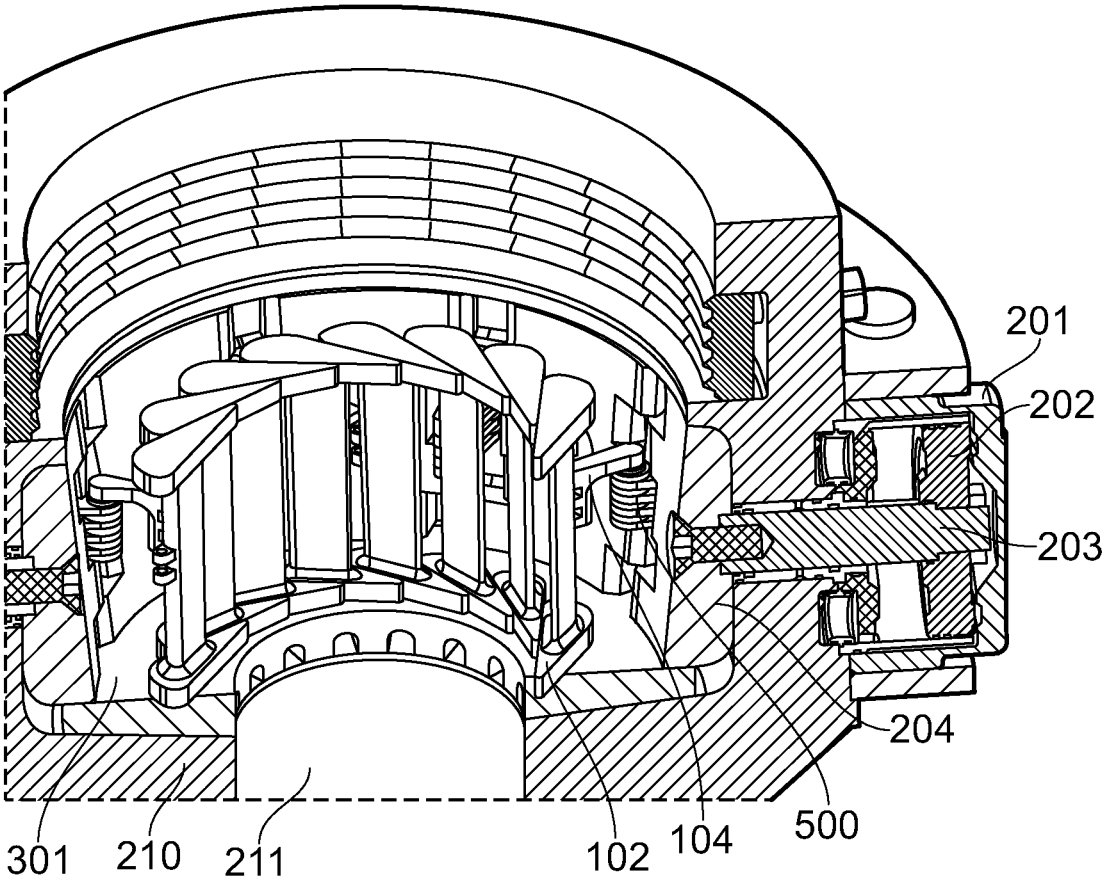
FIG. 3 shows a partial view of the annular blow out preventer of FIG. 2.

FIG. 3 shows the annular blowout preventer of FIG. 2 in a different view. The housing 210 has an annular recess 301 about the central bore 211. In use, the central bore 211 forms part of a wellbore. The packer arrangement 100 is positioned in the annular recess 301 (for the sake of clarity, FIG. 3 shows the packer arrangement without the annular packer element 101). By operating the actuators 200, the packer arrangement 100 may thus form a sealing engagement about an object in a wellbore, for example, a drill pipe or a wireline, or seal upon itself when the wellbore is empty. The piston stems 203 of the actuators 200 are connected with and act directly on the pusher plates 204.

As can be seen in FIG. 3, the retractor parts 104 connect the packer inserts 102 to the pusher plates 204 via the packer retractor mechanism 500. Each triangular shaped upper and lower body 109*a*, 109*b* of each packer insert 102 is in contact with the adjacent triangular shaped body of the adjacent packer insert 102 so that the triangular shaped upper and lower bodies 109*a*, 109*b* form two ring shaped elements surrounding the central bore 211, around which the packer arrangement 100 is positioned. The annular packer element 101 is thereby supported in its upper and lower regions.

Figure 4:
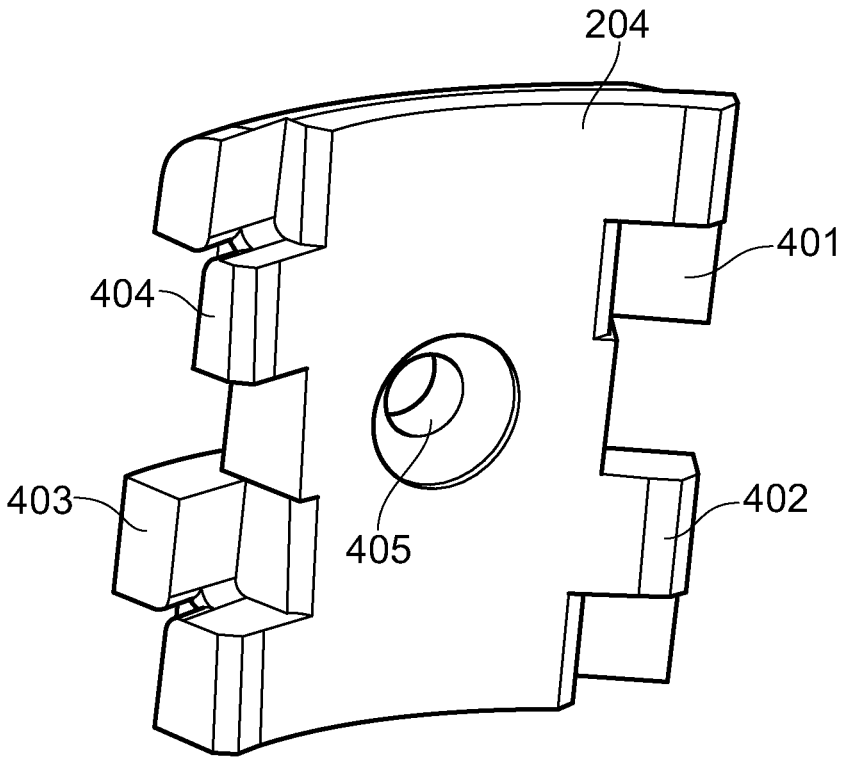
FIG. 4 shows a detailed view of a pusher plate.

FIG. 4 shows a pusher plate 204 in greater detail. The pusher plate 204 comprises first and second edges which, in use, extend generally parallel to the axial passageway through the packer arrangement 100, and which have alternate lateral engagement protrusions 401, 402, 403, 404. The pusher plates 204 are arranged circumferentially around the central bore 211 and when they are driven radially towards the central bore 211 under the action of the actuators 200, the engagement protrusions 401, 402, 403, 404 of neighboring (i.e., adjacent) pusher plates 204 engage/interlock with each other.

Under the action of the actuators 200, the pusher plates 204 will therefore interweave so as to form a continuous ring shaped element around the packer arrangement 100.

FIG. 4 also shows that each pusher plate 204 is provided with a central opening and recess 405. The central opening and recess 405 connects the pusher plate 204 to the piston stem 203 of the actuators 200. The pusher plates 204 have an inner curved surface generally conforming with the outer curved surface of the annular packer arrangement 100 so that they form a substantially circular element that surrounds the outer periphery 101*a* of the packer arrangement 100.

During closing of the blowout preventer, there is lateral engagement between adjacent pusher plates 204 and the pusher plates 204 contact the outside diameter of the annular packer element 101. In conventional designs, this action may cause damage to the outside diameter of the annular packer element 101 during repeated open and close cycles, as a portion of the annular packer element 101 is pinched between adjacent pusher plates 204. The lateral engagement in this construction reduces damage to the annular packer element 101 via the overlapping engagement protrusions 401, 402, 403 404. During closing, the engagement protrusions 401, 402, 403, 404 thus overlap those of the adjacent plates 204 so that the plates interweave/interlock and form a continuous ring shape element around the annular packer element 101. The pattern of the engagement protrusions 401, 402, 403, 404 provides synchronized movement of the plates 204. This also provides a more robust synchronization of the actuator pistons 202 than, for example, the dowel pins known from conventional designs. For example, one known design uses dowel pins protruding from one side of each pusher plate to engage holes in the opposite side of each pusher plate.

Figure 5:
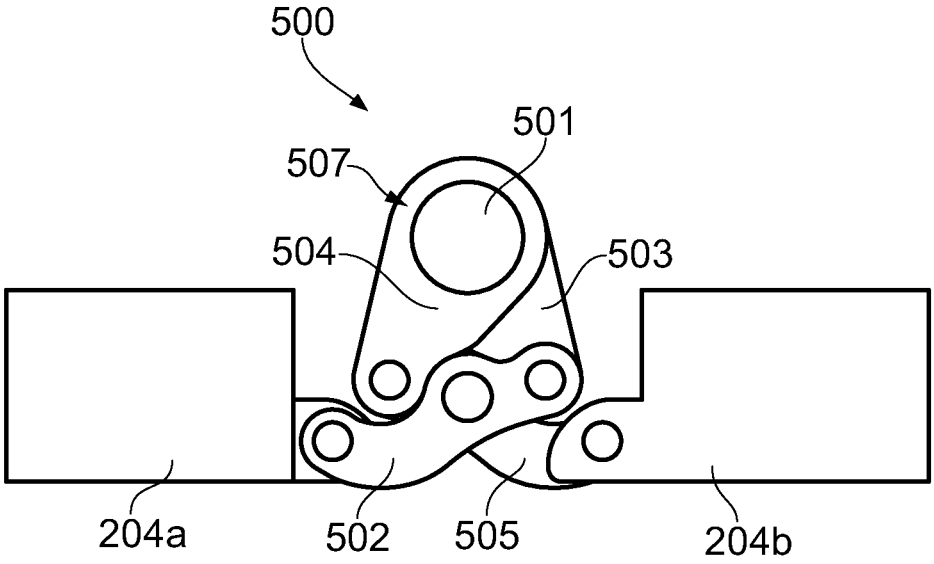
FIG. 5 shows two pusher plates and a linkage mechanism in an open position.

As mentioned above, the packer actuation system further comprises a retractor arrangement 240. The retractor arrangement 240 includes a packer retraction mechanism 500 and the retractor parts 104. FIG. 5 shows the packer retraction mechanism 500 in greater detail. The packer retraction mechanism 500 has a first connection formation (also known as a first fixation point) to be attached to a first pusher plate 204*a* and a second connection formation (also known as a second fixation point) to be attached to a second pusher plate 204*b* which is adjacent to the first pusher plate 204*a*.

The packer retraction mechanism 500 of the present invention is also provided with a third connection formation (also known as a third fixation point) to be attached to a retractor part 104 which is connected to one of the packer inserts 102 disposed within the annular packer element 101 of the blowout preventer. The retractor part 104 extends radially outwardly of the annular packer element 101 generally perpendicular to its central bore 211. A first end of each retractor part 104 is pivotally connected to the packer insert 102, while a pin 106 is provided at the other end of the retractor part 104. The pin 106 extends generally parallel to the axial passageway 121 of the annular packer element 101 and is used to connect the annular packer element 101 to the packer retraction mechanism 500, as will be described further below.

Figure 6:
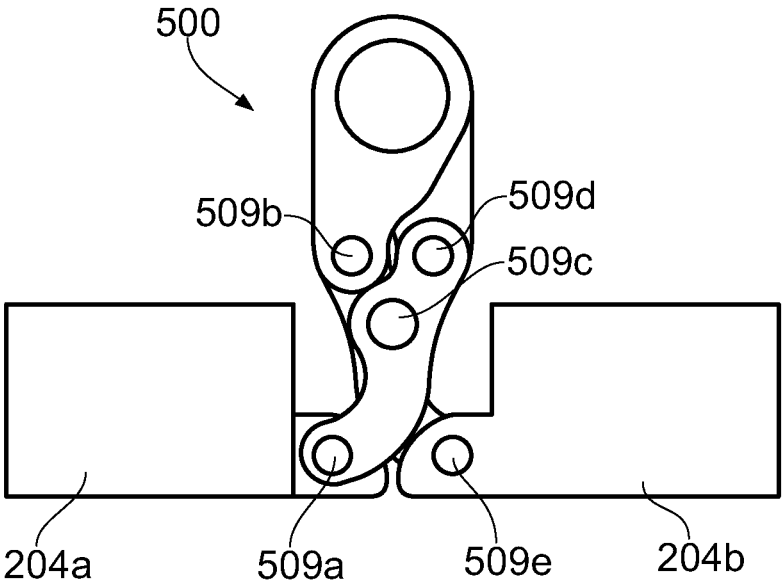
FIG. 6 shows two pusher plates and a linkage mechanism in a closed position.

FIGS. 5 and 6 show that the packer retraction mechanism 500 comprises a first, second and third portions (also known as flat portions) 507, 502, 505 pivotally connected to one another via five pivot points 509*a*, 509*b*, 509*c*, 509*d*, 509*e* having parallel pivoting axes. The first portion 507 of the packer retraction mechanism 500 comprises an opening/hole 501 and two legs 503, 504 which are pivotally connected about the hole 501. The second and third portions 502, 505 have a central pivot point which allows for a relative movement of the second and third portions 502, 505 relative to one another. The second and third portions 502, 505 are similar but have an inverted shape with respect to one another and are located one on the other so that their central portion is superposed to form the central pivot point 509*c*. As shown in FIGS. 5 and 6, the shape of the second and third portions 502, 505 comprises three crests in between two shallow parts. This shape provides that the second and third portions 502, 505 are complementary with the shape of the legs 503, 504 of the first portion 507 when the legs are fully opened (FIG. 5) and when the legs are closed (FIG. 6).

The first central pivot point 509*c* is located in the central part of the second and third portions 502, 505 and allows these two portions to slide against/move relative to each other. The second and third portions 502, 505 are each pivotally connected to a pusher plate 204*a*, 204*b* on one end so that, when the two portions slide against each other, the adjacent pusher plates 204*a*, 204*b* are displaced in a direction perpendicular to the pivoting axis of each pivot point.

The second and third portions 502, 505 are also each pivotally connected to a leg 503, 504 of the first portion 507 on their other end so that, when the legs of the first portion 507 pivot about the hole 501, this forces the second and third portions 502, 505 to pivot about the central pivot point 509*c*, and thus displace the adjacent pusher plates 204*a*, 204*b* in a direction perpendicular to the pivoting axis of each pivot point.

It should be appreciated that in this embodiment, the packer retraction mechanism 500 is connected to the pusher plates 204, but this need not necessarily be the case. The packer retraction mechanism 500 could be connected directly to an actuator 200 and move independently of the pusher plates 204.

In this embodiment, each packer retraction mechanism 500 is installed in between two adjacent pusher plates 204*a* and 204*b* (the pusher plates being shown flat for simplicity) and comprises a pantographic mechanism having articulated linkages between the pusher plates 204*a*, 204*b*. The two adjacent pusher plates are thus linked by a pantograph mechanism in an articulated manner that permits them to move, in a limited way, one towards the other when pushed by the actuators 200 or one away from the other when retracted by the actuators 200. When the separation of the pusher plates 204 increases, the separation of the pivotal connections 509*b*, 509*d* between the legs 503, 504 and its respective second 502 or third 505 portion also increases. The legs of the first portion 507 thus pivot away from one another so that the hole 501 moves towards the pusher plates 204. This is illustrated in FIG. 5. Conversely, when the separation of the pusher plates 204 decreases, the separation of the pivotal connections 509*b*, 509*d* also decreases. The legs 503, 504 of the first portion 507 thus pivot towards one another so that the hole 501 moves away from the pusher plates 204. This is illustrated in FIG. 6.

As mentioned above, each packer retraction mechanism 500 is also provided with an opening 501 (i.e., the opening 501 of the first portion 507) and, in use, this opening 501 engages with the fastening means/connection part/pin 106 of a retractor part 104. The packer inserts 102 of the annular packer element 101 and the pusher plates 204 are thus linked together so that their movements are interrelated.

FIG. 5 shows the packer retraction mechanism 500 and pusher plates 204*a*, 204*b* when the annular blowout preventer is in an open/expanded position (i.e., the axial passageway through the packer arrangement 100 has a maximum size/dimension). In this configuration, the pusher plates 204*a*, 204*b* and the packer retraction mechanism 500 are in their outermost position, i.e., the two adjacent plates 204*a*, 204*b* are as distant as possible. The pusher plates 204 of the contractor arrangement 230 forming a discontinuous circular element that surrounds the outer periphery 101*a* of the packer arrangement 100. FIG. 6 shows the packer retraction mechanism 500 and pusher plates 204*a*, 204*b* when the annular blowout preventer is in a closed/contracted position (i.e., when the axial passageway through the packer arrangement 100 is at a minimum size/dimension). In this configuration, the pusher plates 204 and the packer retraction mechanism 500 are in their innermost position, i.e., the two adjacent plates 204*a* and 204*b* have their protrusions interwoven/interlocked (not shown for simplicity). The pusher plates 204 of the blowout preventer thus form a continuous circular element that surrounds the outer periphery 101*a* of the compressed packer arrangement 100.

Figure 7:
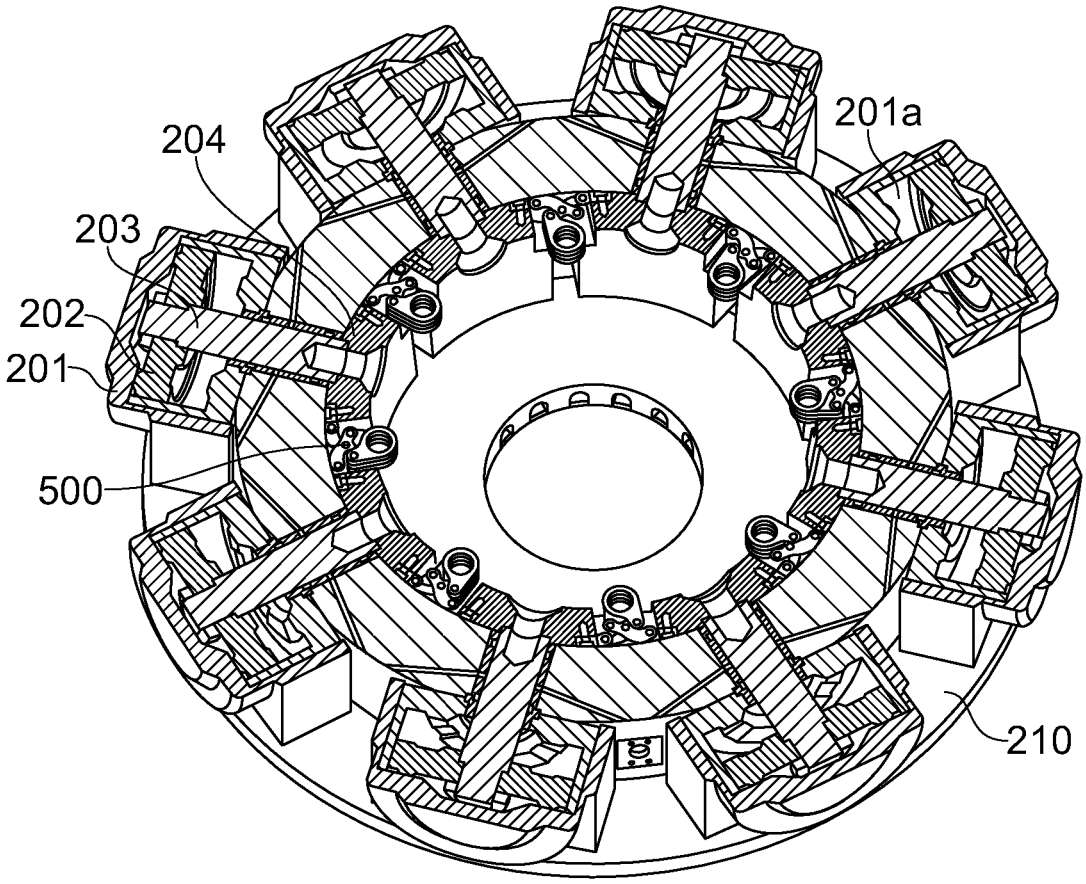
FIG. 7 shows a housing of an annular BOP with actuators in an open position.
Figure 8:
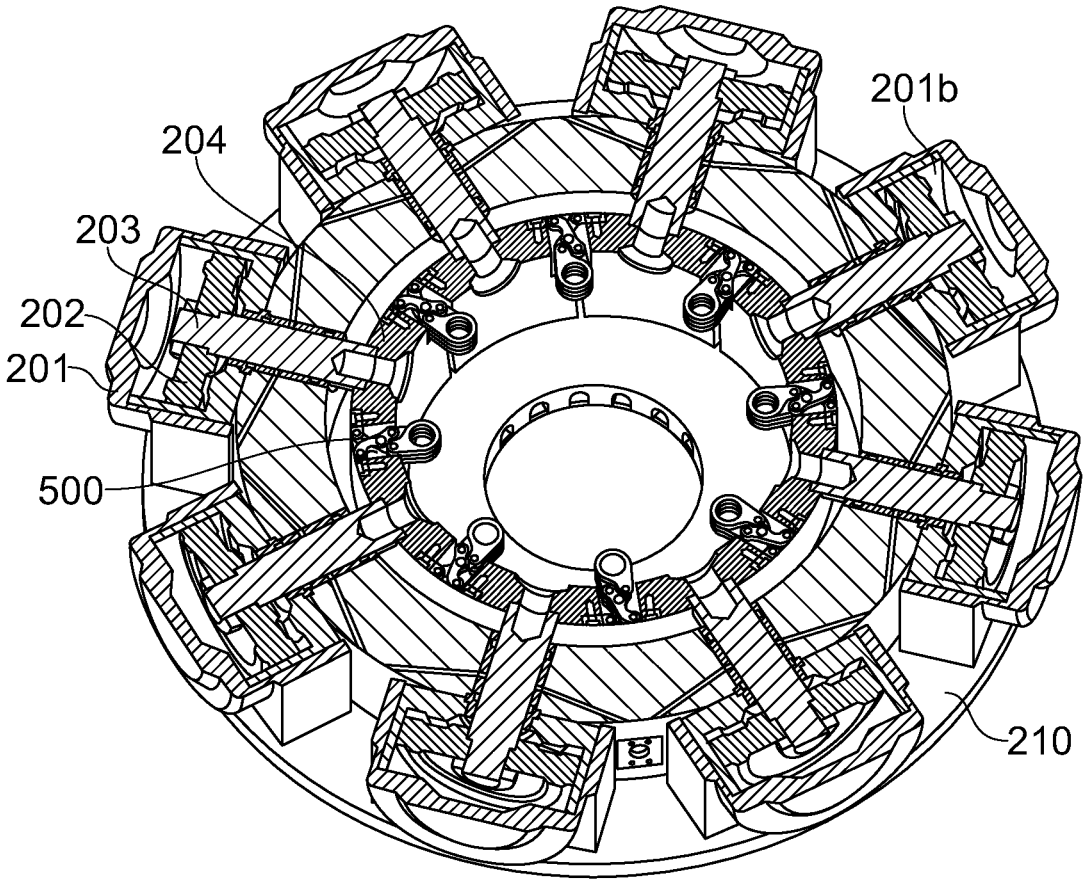
FIG. 8 shows a housing of an annular BOP with actuators in a closed position.

FIGS. 7 and 8 illustrate the operation of the annular blowout preventer. For simplicity, the annular packer element 101 is not shown. FIG. 7 shows the annular blowout preventer in an open/expanded position. In this case, the pistons 202 in the hydraulic actuation cylinders 201 are fully retracted via the supply of pressurized fluid to the open chamber 201*a* and the venting of fluid from the closed chamber 201*b*, and the pusher plates 204 and the linkages of the packer retraction mechanism 500 are in their outermost position. FIG. 8 shows the annular blowout preventer in a closed/contracted position, achieved by the supply of pressurized fluid to the closed chamber 201*b* and the release of fluid from the open chamber 201*a*. In this case, the pistons 202 in the hydraulic actuation cylinders 201 are fully advanced, and the pusher plates 204 and the packer retraction mechanism 500 are in their innermost position.

During closing, i.e., going from the state in FIG. 7 to that in FIG. 8, the pusher plates 204 and packer retraction mechanism 500, via the actuators 200, push the packer arrangement 100 towards the center of the bore, thus closing the annular blowout preventer (thus, the axial passageway of the packer arrangement 100 decreases in size/dimension). During opening, i.e., going from the state in FIG. 8 to that in FIG. 7, the packer retraction mechanism 500, via the return (radially outwards) force of the actuators 200, will retract the packer arrangement 100 away from the center of the bore, thus opening the annular blowout preventer (moving to the expanded position thus increases the dimension/size of the axial passageway through the packer arrangement 100).

As the pusher plates 204 are forced to retract by the actuators 200 upon opening the BOP, the packer retraction mechanism 500 engage with the packer inserts 102 via the retractor part 104. The packer inserts 102 (that are embedded within the annular packer element 101) are pulled radially outwards and fully open the annular packer element 101.

In this embodiment, the engagement of the retractor part 104 and the retraction mechanism 500 (e.g., the pin 106 through the opening 501) may take place when the annular packer element 101 is lowered (with the annular packer element 101 arranged so that the pin(s) 106 extends downwardly from the end of the retractor parts 104) into the BOP housing during installation, so that the pin 106 of each retractor part 104 slides into the opening 501 of one of the packer retraction mechanisms 500.

According to the present invention, there is thus provided a device to actively retract the packer arrangement 100 to the fully open position. Conventional annular BOPs rely on the strain energy stored in the resilient packer element to provide the force necessary to urge the packer arrangement to the fully open position. Cold weather or loss of elasticity in the rubber due to fatigue can slow this opening process significantly, or can cause the BOP to fail to fully open. The new structure described here permits the use the BOP operating system to urge the packing to the fully open position in a positive and expeditious manner. A further advantage is the ability to use elastomer materials which are very durable, but which lack sufficient elasticity to fully open within a practical time interval.

Another advantage provided by an embodiment of the present invention is that the packer arrangement 100 is releasable from the actuation system. The pins 106 can simply slide out of the openings 501 in the packer retraction mechanisms 500 as the annular packer element 101 is lifted up. Since the resilient material of the annular packer element 101 is more prone to damage and/or wear that the actuators 200 and/or the contractor arrangement 230 and/or the retractor arrangement 240, it is advantageous to be able to replace the packer arrangement 100 without needing to replace the other parts at the same time.

In all embodiments described, the packer inserts 102 can, for example, be made of metal, but can also be made of any resistant material rigid enough to resist the environment of and the retractable force exerted by the actuators 200 on the pusher plates 204 and packer retraction mechanism 500 and thus on the packer inserts 102. It should be appreciated that the contractor arrangement 230 (e.g., the pusher plates 204) and the retractor arrangement 240 (e.g., the retraction mechanism 500) may also be made of metal.

Figure 9:
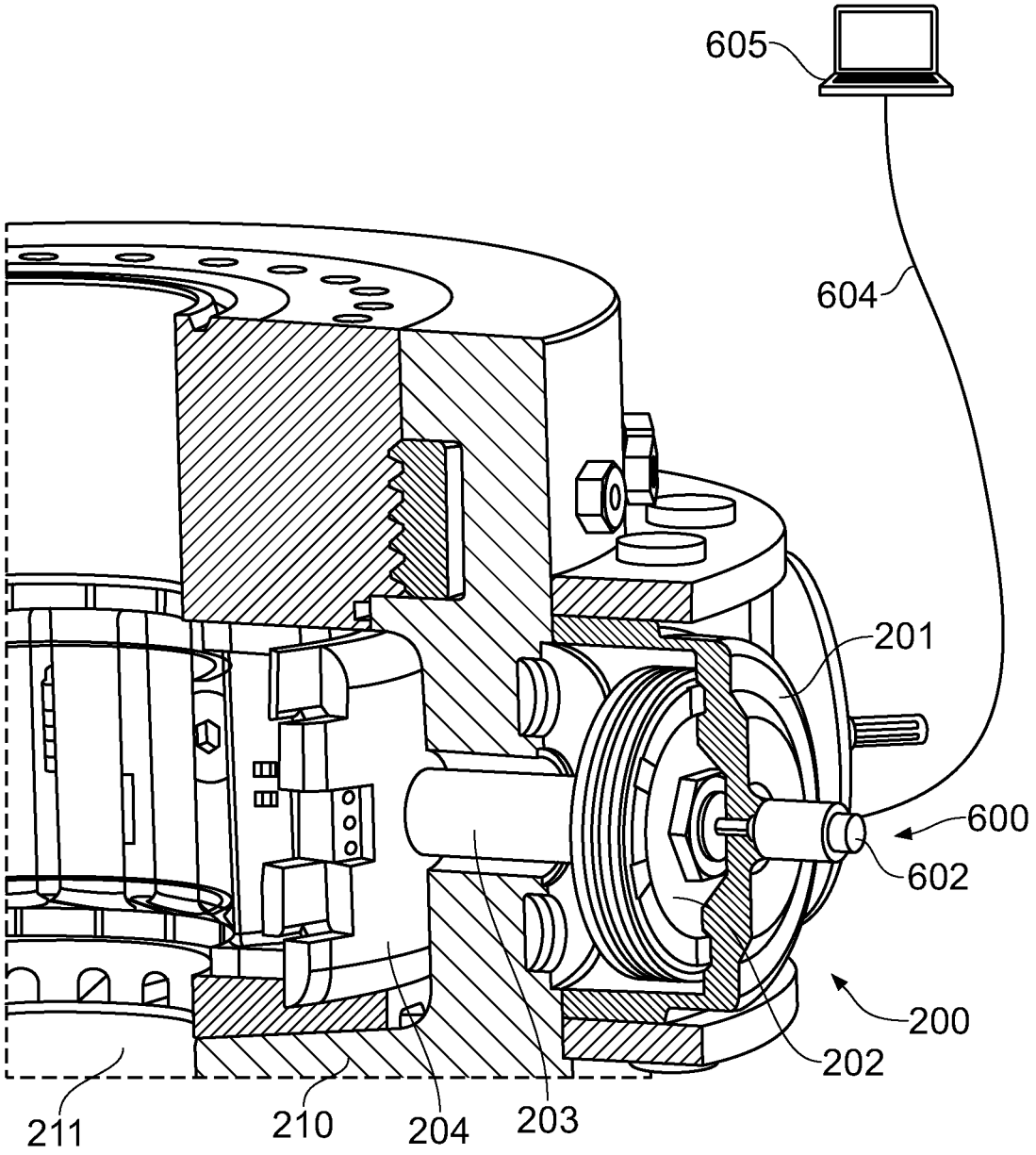
FIG. 9 shows an annular BOP having a position indicator system.
Figure 10:
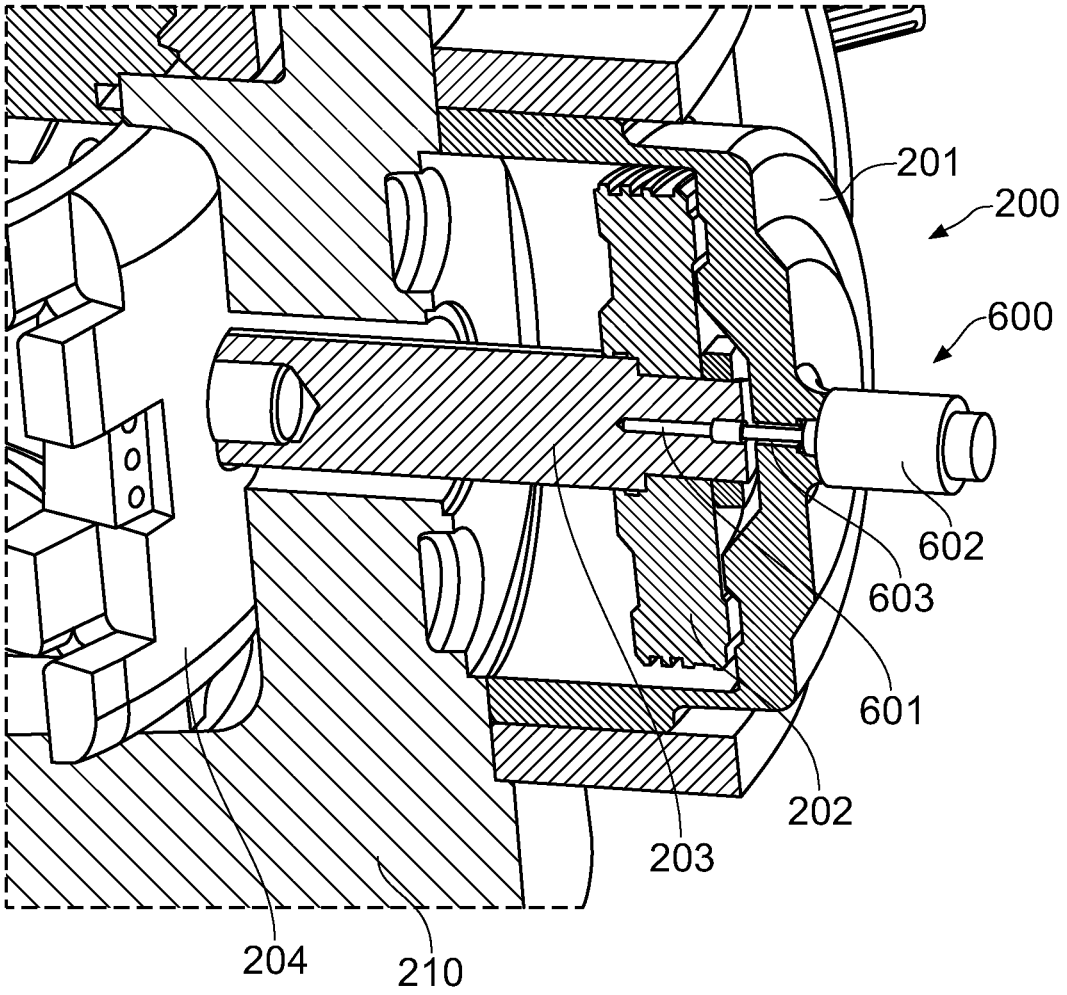
FIG. 10 shows an annular BOP having a position indicator system.

In a further aspect of the present invention illustrated in FIGS. 9 and 10, a position sensor 600 is arranged on the actuator 200 to measure the position of the movable element in the actuator. In the embodiment shown, the movable element comprises the pusher plate 204, the piston stem 203, and the piston 202. The position sensor 600 may comprise a stationary part and a movable part. In the embodiment shown, the position sensor 600 is a magneto restrictive linear displacement transducer, where the stationary part is a sensor housing 602 which is fixed on the housing of the actuator 200 while the movable part is a pin 601 fixed on the piston stem 203. A bore 603 through the housing of the actuator allows the pin 601 to extend into the sensor housing 602.

It is possible via the position sensor 600 to identify, at any desired time, the position of the actuator, and thereby the position of a packer in the annular blow out preventer. The sensor readings from the position sensor 600 can be transmitted via a signal cable 604 to a computer system 605 for storage, display or processing, as illustrated schematically in FIG. 9. If the blow out preventer is used subsea, the computer system 605 may be located topside on a platform, or onshore.

Having a position sensor 600 arranged as described above allows for a monitoring of BOP functionality at all times, as well as using the sensor data to obtain information about the reliability and operational state of the BOP. It is possible, for example, to establish with more certainty that the annular BOP has reached the fully open position after having been closed, which is important, for example, when entering large tools down into the wellbore. Such tools may otherwise get stuck, or even damage the tool or the BOP, if the annular BOP is not correctly opened.

The position sensor 600 can be used to obtain an indication of packer wear. When the packer is in service over a period of time, the resilient material will in particular wear at its inner circumference. This may require the actuator to provide a longer stroke in order to fully close the BOP. By comparing the actual closing stroke or actuator end position to a nominal value, an indication can be obtained as to whether the annular BOP requires replacement and whether it is fit for continued service.

The position sensor can thus be used for determining the condition of a packer arrangement for an annular blow out preventer, by actuating the packer actuation system to close on either a drill pipe of known diameter or on itself (i.e., without a drill pipe extending along the central bore 211 through the annular packer element 101), then reading a position value of the movable actuation element measured by the position sensor 600, and comparing the position value to a pre-determined, nominal position value. If a longer actuation stroke than the nominal value is required, that can then be taken as an indication that the packer element is worn. The difference between an actual stroke length and a nominal value may provide an indication of how much the packer element is worn.

Figure 11:
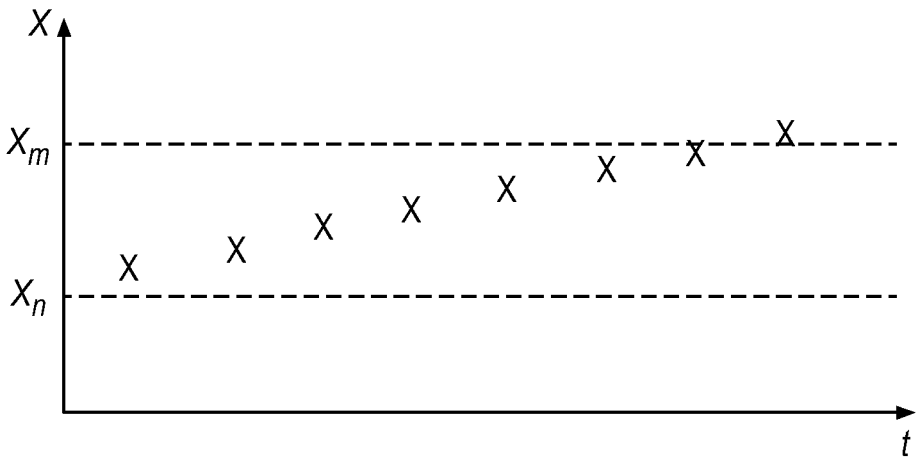
FIG. 11 illustrates aspects of a method for determining the condition of an annular BOP.

The process of reading the end position of the actuator in the closed state, either with the annular BOP closed on a pipe of known diameter (such as drill pipe) or on itself can be repeated on a plurality of occasions over time, and the measured position value recorded on each occasion. The resulting data can be used in the creation of a position measurement over time graph, as illustrated in FIG. 11, where x denotes the displacement required by the actuator to fully close the annular BOP in a given state (e.g., around a regular drill pipe). The data points indicate different readings of actual closing displacement, taken at different times t. A nominal actuator displacement value $x_n$ is provided, for example, that value obtained by test data as the value required to close the annular in the newly installed state. A limit displacement value $x_m$ indicates a displacement value which requires replacement of the annular because the packer element may be so worn or has otherwise lost its properties that its operational integrity is no longer sufficient.

Figure 12:
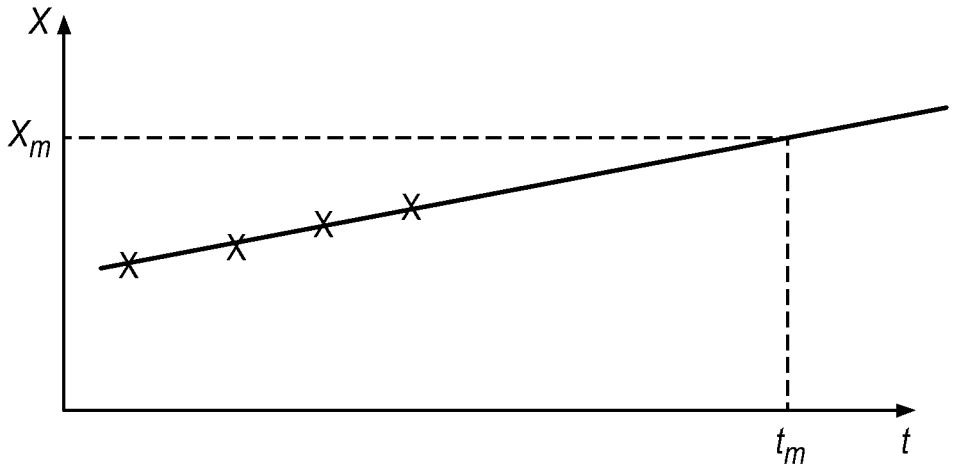
FIG. 12 illustrates aspects of a method for determining the condition of an annular BOP.

By comparing subsequent readings of the closing displacement, a time $t_m$ when the packer element would need replacement can also be predicted. This is illustrated in FIG. 12, where a set of position readings is extrapolated to predict a time $t_m$ at which the threshold displacement value $x_m$ which would require replacement, is reached.

Computer system 605 may be programmed to output a warning signal (visual or audible) to alert an operator if the latest position reading suggests that the annular packer element 101 is so worn that it requires replacement, i.e., being close to or higher than $x_m$. The computer system may in this case be configured to issue a series of staggered warnings, for example, a yellow warning when the annular packer element 101 has worn by a first pre-determined amount, an orange warning when the annular packer element 101 has worn by a second, greater, pre-determined amount, and, as such, the need for replacement being imminent, and a red warning when the annular packer element 101 has worn by a third, even greater, amount and needs immediate replacement.

Computer system 605 may, alternatively or additionally, be programmed to output a remaining useful lifetime value, a wear rate value, and/or a predicted time for maintenance value, $t_m$, to an operator. The wear rate may be calculated based on a development in the packer wear readings, e.g., as a function of the slope shown in FIG. 12. The remaining useful lifetime value may be calculated based on a calculated packer condition value, established as described above, and a predicted packer wear rate based on an estimated future usage rate.

Via the system and/or method according to aspects of the present invention, such replacement and maintenance of the BOP can, for example, be better planned in advance and, for example, combined or coordinated with other maintenance activities.

According to aspects of the present invention, the operational integrity of such safety critical components as annular blow out preventers may therefore be provided and predicted in an improved manner.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the present invention in diverse forms thereof. Reference should also be had to the appended claims.

What is claimed is:

1. A blowout preventer comprising:

a resilient packer element; and a contractor arrangement comprising:

a pantographic packer retractor mechanism, and a plurality of plates arranged adjacent to one another, the plurality of plates being arranged so as to enclose an enclosed area, the contractor arrangement being configured to move from an expanded position to a contracted position in which the enclosed area decreases, wherein adjacent plates of the plurality of plates are configured to interlock with one another when in the contracted position, and the contractor arrangement is arranged to surround the resilient packer element.

2. The blowout preventer as recited in claim 1, wherein each of the plurality of plates has an arcuate shape.

3. The blowout preventer as recited in claim 2, wherein each of the plurality of plates comprises a first edge and a second edge, the first edge and the second edge of each of the plurality of plates comprising alternating protrusions with respect to each other so that the second edge and the first edge of each of the plurality of plates which are adjacent to each other engage and interlock in the contracted position.

4. The blowout preventer as recited in claim 1, further comprising:

an axial passageway, wherein the pantographic packer retractor mechanism comprises a second portion and a third portion each of which comprise a first end and a second end arranged opposite thereto, the second portion and the third portion each being pivotally connected at their respective first end to adjacent plates of the plurality of plates, and the pantographic packer retractor mechanism is operable so that when the adjacent plates of the plurality of plates are moved towards one another, a respective second end of the second portion and of the third portion moves towards the axial passageway of the blowout preventer, and when adjacent plates of the plurality of plates are moved apart from one another, the respective second end of the second portion and of the third portion move away from the axial passageway.

5. The blowout preventer as recited in claim 4, wherein the pantographic packer retractor mechanism further comprises a first portion which comprises two legs pivotally connected about an opening, and the second end of the second portion and of the third portion is pivotally connected to the first portion.

6. The blowout preventer as recited in claim 5, further comprising:

a packer insert, wherein the opening of the first portion provides a releasable connection to the packer insert.

7. The blowout preventer as recited in claim 5, wherein, the second portion and the third portion comprise a common central pivot point, each of the first portion, the second portion, and the third portion are pivotally connected one to another about four pivot points, each of which comprise a pivot axis which is parallel to each other so that, when the contractor arrangement moves to the contracted position, the second portion and the third portion move relative to one another about the common central pivot point, the two legs of the first portion are forced to move relative to each other, and the opening moves away from the adjacent plates of the plurality of plates, and the common central pivot point is one of the four pivot points.

* * * * *